United States Patent [19]

Westdorp et al.

[11] Patent Number: 5,006,061

[45] Date of Patent: Apr. 9, 1991

[54] METHOD FOR BRINGING A PLURALITY OF STEEL SLABS TO ROLLING TEMPERATURE IN A FURNACE

[75] Inventors: Rudy Westdorp, Beverwijk; Frans P. Muysken, Haarlem, both of Netherlands

[73] Assignee: Hoogovens Groep B.V., Ijmuiden, Netherlands

[21] Appl. No.: 481,644

[22] Filed: Feb. 5, 1990

Related U.S. Application Data

[63] Continuation of Ser. No. 268,374, Nov. 7, 1988, abandoned.

[30] Foreign Application Priority Data

Nov. 11, 1987 [NL] Netherlands ..... 8702689

[51] Int. Cl.[5] ..... F27D 3/00

[52] U.S. Cl. ..... 432/11; 432/12; 432/43; 432/128; 432/49

[58] Field of Search ..... 432/11, 12, 36, 43, 432/45, 49, 128

[56] References Cited

U.S. PATENT DOCUMENTS

| | | | |
|---|---|---|---|
| 3,385,579 | 5/1968 | Peck et al. . | |
| 4,338,077 | 7/1982 | Shibayama et al. | 432/11 |
| 4,368,034 | 1/1983 | Wakamiya | 432/11 |
| 4,373,364 | 2/1983 | Tanimoto et al. | 432/11 |
| 4,577,278 | 3/1986 | Shannon | 432/11 |
| 4,606,006 | 8/1986 | Kitao et al. | 432/11 |
| 4,606,529 | 8/1986 | Tooch | 266/80 |

FOREIGN PATENT DOCUMENTS

| | | |
|---|---|---|
| 3044562 | 9/1981 | Fed. Rep. of Germany . |
| 3332489 | 3/1984 | Fed. Rep. of Germany . |
| 6902415 | 8/1969 | Netherlands . |
| 7017994 | 6/1971 | Netherlands . |

*Primary Examiner*—Henry C. Yuen

*Attorney, Agent, or Firm*—Stevens, Davis, Miller & Mosher

[57] ABSTRACT

A method for bringing a plurality of steel slabs to rolling temperature uses a furnace having a controllable energy supply. To accommodate variation of slab temperature at entry, especially mixing of cold and hot slabs, at least one virtual slab corresponding to a group of the steel slabs is determined, and the energy supply is adjusted in dependence on the desired mean temperature at exit from the furnace of the virtual slab. Suitably the furnace has at least two zones each with an individually controllable energy supply, and virtual slabs are determined for the slabs in each zone. Then the energy supply in each zone is adjusted in dependence on the desired mean temperature at exit from the furnace of the virtual slab of that zone and preceding zones.

6 Claims, 1 Drawing Sheet

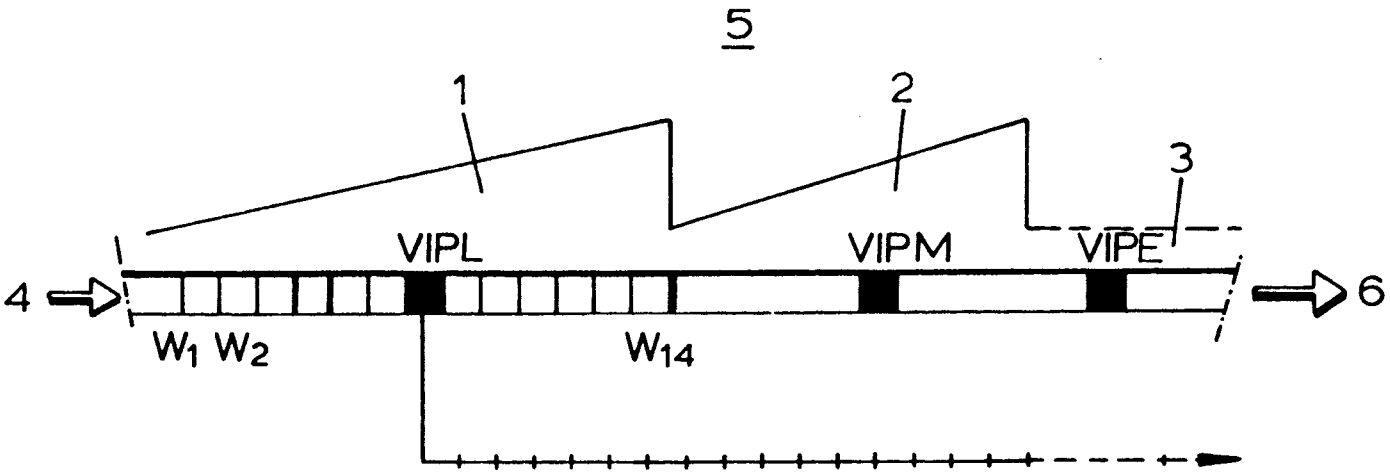
5
1
2
3
4
6
VIPL
VIPM
VIPE
$W_1$ $W_2$
$W_{14}$

METHOD FOR BRINGING A PLURALITY OF STEEL SLABS TO ROLLING TEMPERATURE IN A FURNACE

This application is a continuation of application Ser. No. 268,374, filed Nov. 7,1988 now abandoned.

BACKGROUND OF THE INVENTION

1. Field of the Invention

The invention relates to a method of operating a furnace, in particular a method for bringing a plurality of steel slabs to rolling temperature in a furnace with controllable energy supply. The method is particularly applicable in hot-strip mills.

2. Description of the Prior Art

Furnaces, continuous reheating furnaces or walking beam furnaces used in hot-strip mills usually have three heating zones, namely a charging zone, a central zone and an end zone. Each of these zones has a controllable energy supply. A typical furnace can have a furnace charge of thirty-eight steel slabs of about one metre width, of which at any time fourteen are in the charging zone, ten in the central zone and the rest in the end zone. Every three to five minutes a new steel slab is fed into the charging zone, and a steel slab which is at rolling temperature leaves the end zone, all according to the known "first in, first out" principle.

A steel slab is at rolling temperature when it has passed through a curve or pattern of temperatures, from its initial temperature on being charged into the furnace, in such a way that the steel slab is well heated through and the outermost layers of the steel slab are not overheated. That is to say, the core of the steel slab must have reached a desired temperature which in principle is the same temperature as the outermost layers of the steel slab. However, on account of the heat transfer needed from the outside of the steel slab towards the core, it is permissible and necessary to have a variation in the temperature level of these outermost layers. Too low a temperature at the upper side of the steel slab creates undesirable curling up phenomena of the steel slab as a result of cooling. Even so the temperature on the outside of the steel slab must remain within tight limits in order, among other reasons, to hinder oxidation on the surface of the steel slab.

One conventional method of controlling a furnace consists of specifying a desired temperature level of the gas in the furnace in each zone, the levels being related to the desired curve of temperatures for each slab. The energy supply into each zone is dependent on the temperature level in each zone at any time. See U.S. Pat. No. 4,501,522 for a particular description of a method of this general kind.

This known method is satisfactory if there is stable or steady state operation of the hot-strip mill and of the furnace. Disturbances in the so-called "pulling speed" that is to say the frequency at which a steel slab is taken out of the end zone of the furnace in order to be rolled out, may still be accommodated in the known method, when those disturbances are not too massive. However, it is different where these disturbances becomes greater, for example as a result of interruptions in rolling out, leading to the furnace being run at a reduced level for a longer period.

Even more significant are disturbances resulting from varying starting conditions of the steel slabs. The existing method is unable to deal with these satisfactorily. In particular, a problem arises when the starting temperature of subsequent steel slabs differ from one another.

This problem has gained particular urgency because of the rise in production of continuously cast slab material. From the point of view of operating economy and for energy reasons, there are advantages in further processing such steel slabs in the hot-strip mill as quickly as possible after the continuous casting. It is advantageous for operating economy because in this way holding of interim stocks between the continous casting plant and the hot-strip mill is avoided, and the throughput time from the start of the continuous casting and the end of rolling is reduced. It is advantageous for energy reasons because less energy is needed to bring hot steel slabs charged directly into the furnace of the hot-strip mill up to the desired rolling temperature.

In practice, however, the entire furnace charge may not consist of directly charged continuously cast material. In practice the hot-strip mill furnace is charged both from a store holding a stock of steel slabs cooled to ambient temperature and with steel slabs still hot from the continuous casting process. These hot steel slabs having a temperature of 400°-600° C. These steel slabs and the steel slabs with a temperature of about 20° C. must all be heated up to about 1200°-1260° C.

U.S. Pat. No. 4,338,077 describes one method of attempting to deal with this problem. The temperature patterns are controlled in dependence on the position of a boundary material, which is the first material of a group of hot or cold slabs. The present invention is based on a different concept.

SUMMARY OF THE INVENTION

It is the object of the invention to provide a method which brings all of the many steel slabs, which need to be brought to rolling temperature in a furnace, to a temperature within a range at the rolling temperature which is acceptable in practice, while conveying relatively cold and hot steel slabs into the furnace in random sequence.

It is known from the theory of multi-variable control systems that for each steel slab to be variably controlled, in the case in point for each local temperature of a steel slab, at least one magnitude of control must be available.

In accordance with that theory, with three furnace zones to be freely controlled, it is only possible to control at the most the temperature of three steel slabs exactly.

In accordance with the invention this method is characterized in that at least one virtual slab corresponding to at least one group of the steel slabs is determined and notionally positioned in the furnace, and in that the energy supply for each zone is adjusted in dependence on the desired mean temperature average temperature of the slab on exit from the furnace of the virtual slab or slabs. Furthermore, with the invention, the quality of the hot rolled product can be improved, which is thought to be because the steel slabs are heated through homogeneously.

With a furnace which has at least two zones each provided with an individually controllable energy supply, it is preferable that one such virtual slab is determined from the steel slabs for each zone, and that the energy supply for each respective zone is adjusted in dependence on the desired mean temperature at exit from the furnace of the virtual slab from at least that zone.

The best results are obtained in the method when the energy supply in the zone at the entry side of the furnace is adjusted in dependence on the desired mean exit temperature of the virtual slab of that zone, and that the energy supply in each further zone is adjusted in dependence on the desired mean exit temperature of each virtual slab between the entry zone and the further zone in question inclusive. In this way the furnace control achieves a very stable character and is adjusted earlier to take account of the expected conditions caused by changes in furnace charging.

It is preferable that the energy supply for each zone is also determined by the desired temperature distribution on exit from the furnace of at least one virtual slab. In this manner the curling up of the steel slabs on leaving the furnace may be prevented effectively.

The number of variables to be influenced in an average furnace, and thereby the amount of control magnitudes needed, becomes very large without special measures. Known furnaces having burners both above and below in their charging and central zones, but only above in the end zone. Moreover, there can be differing fuel supply at the head side and tail side of steel slabs in the furnace. A solution for this problem which works particularly well is now achieved in that the total of the energy supply at any time in the zones of the furnace is deduced from the energy supply determined for each virtual slab.

At the same time it is desirable that the distribution of the energy supply at any time over the furnace zones is adjusted depending on the desired temperature distribution on exit from the furnace of at least one virtual slab.

BRIEF INTRODUCTION OF THE DRAWING

The invention will be illustrated in the following by way of non-limitative example, with reference to the drawing, in which:

The FIGURE illustrates schematically a furnace which is suitable to be controlled by the method in accordance with the invention.

DESCRIPTION OF THE PREFERRED EMBODIMENT

In FIG. 1 steel slabs are brought at input 4 into the charging zone 1 of the furnace 5. The furnace has three zones 1, 2, 3. Each steel slab in the furnace 5 runs in sequence through charging zone 1, central zone 2 and end zone 3. On leaving the end zone 3 at output 6 the steel slabs must be at rolling temperature. During normal operation each zone contains a plurality of steel slabs. The energy supply in each zone is independently adjustable.

FIG. 1 illustrates the situation where the charging zone contains a group of fourteen steel slabs $W_1$–$W_{14}$. In accordance with the invention, the fourteen steel slabs $W_1$–$W_{14}$ of charging zone 1 are combined into one virtual slab VIPL. This virtual slab is a calculated arithmetic concept, and is an appropriate average of all the slabs of the group, relating particularly to the temperature distribution in the slabs. In analogous manner, virtual slabs VIPM and VIPE are determined for the central zone 2 and the end zone 3 respectively. All virtual slabs are notionally treated as placed for instance approximately in the centre of the zone in question. Then for each of these virtual slabs VIPL, VIPM and VIPE it is determined what fuel input is desired in each zone in order to bring these virtual slabs up to rolling temperature. This is done in a conventional manner.

For the virtual slab VIPL of the charging zone 1 this leads to a desired fuel input $B_L{}^L$, $B_M{}^L$ and $B_E{}^L$ in the charging zone 1, the central zone 2 and the end zone 3 respectively. For the virtual slab VIPM of the central zone 2 the fuel input in the charging zone 1 is no longer relevant. Consequently for this virtual slab only the desired fuel input in the central zone 2 and the end zone 3 are specified, namely $B_M{}^M$ and $B_E{}^M$ respectively. In analogous manner, the virtual slab VIPE determines only the desired fuel input in the end zone 3, namely $B_E{}^E$.

From the desired fuel inputs for each zone 1, 2 and 3 an actual fuel input is then determined by a suitable combination of the desired fuel inputs. In this way the fuel input in the charging zone is only determined by $B_L{}^L$, thus only by the virtual slab VIPL of the charging zone 1, but for the other zones the fuel input is determined by more virtual slabs than just the local virtual slab.

The fuel input in the end zone 3 is determined for example by all virtual slabs VIPM, VIPE and VIPL in particular in such a way that of the desired fuel inputs $B_E{}^L$, $B_E{}^M$ and $B_E{}^E$, the effect of $B_E{}^E$, i.e. of the virtual slab VIPE of the end zone 3 is the greatest. In this example, the ratio of the contributions of $B_E{}^L$, $B_E{}^M$ and $B_E{}^E$ to the final calculated fuel input to the end zone 3 is 20:50:100.

What is claimed is:

1. Method for bringing a plurality of steel slabs at temperatures of from 20°–600° C. to a mean rolling temperature of 1200°–1260° C. in a furnace having a controllable energy supply to raise the temperatures of said slabs comprising the steps of (i) determining the mean temperatures of all slabs introduced into the furnace, (ii) determining the mean temperature of at least one virtual slab from the mean tempertures of the corresponding group of steel slabs, (iii) calculating the mean exit temperature of the virtual slab from the furnace, (iv) measuring the mean temperature of the slabs exiting from the furnace, and (v) adjusting the energy supply in dependence on the difference in mean temperatures at the exit from the furnace of said virtual slab and the plurality of steel slabs.

2. Method according to claim 1, wherein the furnace has at least two zones each provided with an individually controllable energy supply to raise the temperature of the slabs in each zone, and wherein said step (ii) comprises determining the mean temperatures of said virtual slabs corresponding to the respective group of slabs in each said zone and said step (v) comprises adjusting the energy supply in each said zone in dependence on the calculated mean exit temperature of the virtual slab of at least that zone based upon the difference in mean temperatures at exit from the furnace of said virtual slab, as compared to the desired mean temperatures at exit of said virtual slab.

3. Method according to claim 2, wherein the furnace has a said zone at its entry side and said step (v) comprises adjusting the energy supply in said zone at the entry side of the furnace in dependence on the calculated mean exit temperature of the virtual slab of said zone based upon the difference in mean temperatures at exit from the furnace of the virtual slab of that zone and the desired mean temperatures of the virtual slab of that zone, and adjusting the energy supply in each subsequent said zone in dependence on the calculated mean exit temperatures of the virtual slabs of all zones between said zone at its entry side and that subsequent zone inclusive, based upon the difference in calculated mean exit temperatures of all those virtual slabs between the entry side and that subsequent zone inclusive, as compared to the desired mean temperatures at exit of those virtual slabs.

4. Method according to claim 2 wherein said step (v) comprises adjusting the energy supply in each said zone in dependence also on the desired temperature distribution on exit from the furnace of at least one said virtual slab.

5. Method according to claim 2 including calculating the total energy supply at any time in the zones of the furnace from the energy supply determined for each virtual slab.

6. Method according to claim 2 including adjusting the distribution of energy supplied at any time over the furnace zones in dependence on the desired temperature distribution on exit from the furnace of at least one said virtual slab.

* * * * *